US006769284B1

(12) United States Patent
Dennis

(10) Patent No.: US 6,769,284 B1
(45) Date of Patent: Aug. 3, 2004

(54) HINGE ADJUSTING TOOL

(76) Inventor: Gerald W. Dennis, 14833 Ninth Line, Musselman Lake, Ontario (CA), L4A 7X3

( * ) Notice: Subject to any disclaimer, the term of this patent is extended or adjusted under 35 U.S.C. 154(b) by 0 days.

(21) Appl. No.: 10/462,926

(22) Filed: Jun. 18, 2003

(51) Int. Cl.[7] ..... B21J 13/08

(52) U.S. Cl. ..... 72/457; 72/479; 29/275; 81/165

(58) Field of Search ..... 72/457, 458, 479; 29/275; 81/165, 186, 427.5

(56) References Cited

U.S. PATENT DOCUMENTS

| | | | | | |
|---|---|---|---|---|---|
| 1,747,136 | A | * | 2/1930 | Putnum | 72/31.01 |
| 2,138,651 | A | | 12/1938 | Applegate | |
| 2,732,743 | A | * | 1/1956 | Hart | 72/458 |
| 3,145,849 | A | | 8/1964 | Hanson | |
| 3,332,274 | A | | 7/1967 | Dunstar, Jr. | |
| 3,611,784 | A | | 10/1971 | Prichard | |
| 4,033,044 | A | | 7/1977 | Michaels | |
| 4,034,595 | A | * | 7/1977 | Smith | 72/458 |
| 4,555,929 | A | | 12/1985 | McBee | |
| 5,435,030 | A | * | 7/1995 | Phillips | 29/283.5 |
| 5,937,695 | A | * | 8/1999 | Patterson | 72/458 |
| 6,257,101 | B1 | * | 7/2001 | Marlette et al. | 81/165 |
| 6,450,003 | B1 | * | 9/2002 | Pawson | 72/457 |

* cited by examiner

*Primary Examiner*—David B Jones

(57) ABSTRACT

A hinge adjusting tool includes a rigid elongated member having a first end and a second end. A tubular member is attached to the first end of the elongated member. The tubular member is orientated substantially perpendicular to the elongated member. The tubular member has an upper end and a lower end. The tubular member has a slot extending therethrough. The slot extends between and through the upper and lower ends. A hinge may be selectively positioned in the tubular member such that the hinge may be repositioned.

5 Claims, 2 Drawing Sheets

HINGE ADJUSTING TOOL

BACKGROUND OF THE INVENTION

1. Field of the Invention

The present invention relates to tool devices and more particularly pertains to a new tool device for adjusting the positioning of a hinge so that a door to which it is attached swings properly.

2. Description of the Prior Art

The use of tool devices is known in the prior art. While these devices fulfill their respective, particular objectives and requirements, the need remains for a device that allows for the easy adjustment of hinge, or more particularly, the moving of the loop members of a hinge. Current methods generally use wrenches and the like which may damage and scratch the hinge as it is being adjusted.

SUMMARY OF THE INVENTION

The present invention meets the needs presented above by including a rigid elongated member having a first end and a second end. A tubular member is attached to the first end of the elongated member. The tubular member is orientated substantially perpendicular to the elongated member. The tubular member has an upper end and a lower end. The tubular member has a slot extending therethrough. The slot extends between and through the upper and lower ends. A hinge may be selectively positioned in the tubular member such that the hinge may be repositioned.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
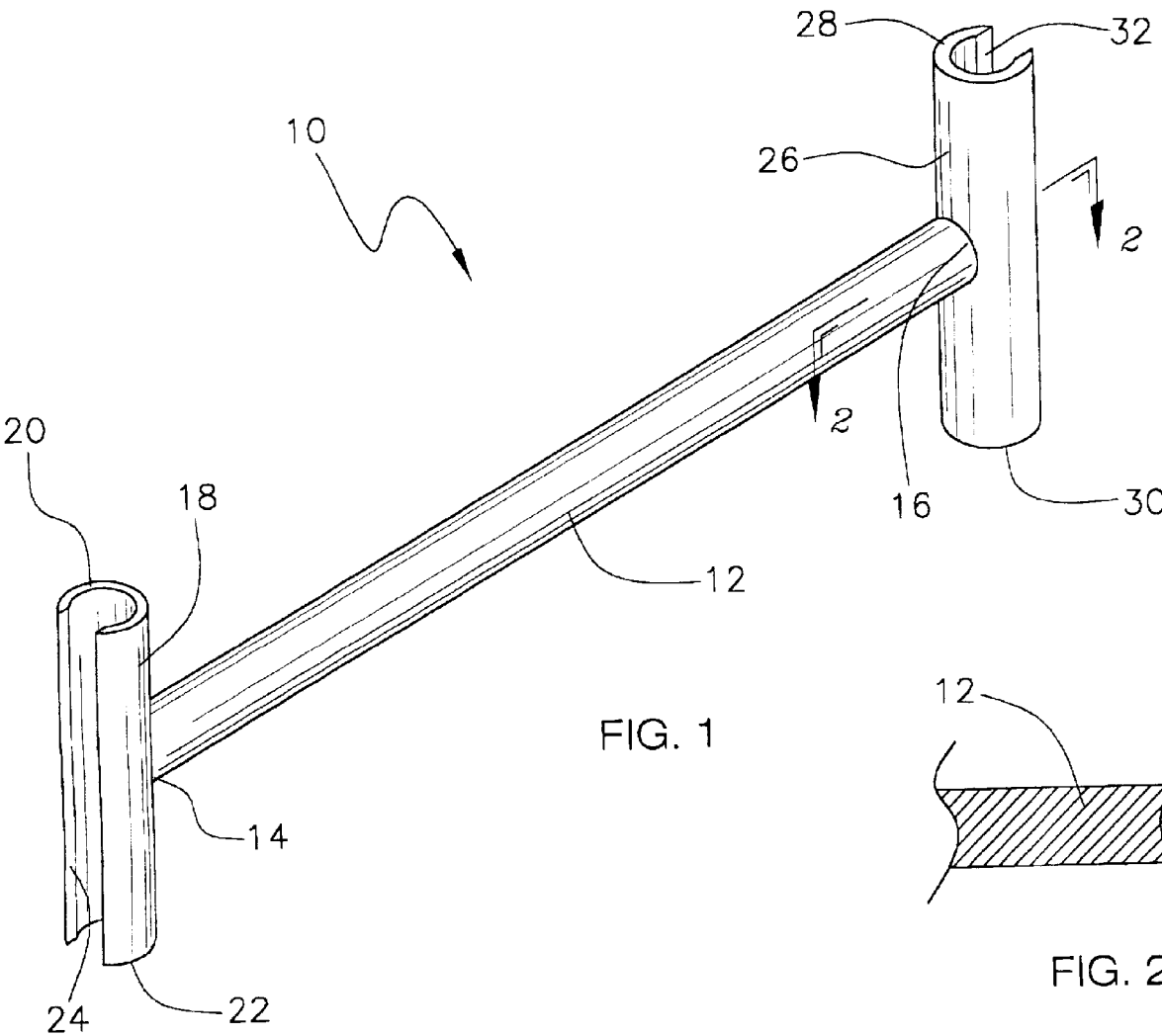
FIG. 1 is a schematic perspective view of a hinge adjusting tool according to the present invention.
Figure 2:
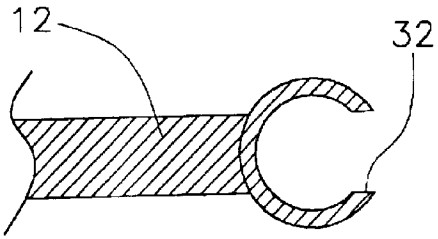
FIG. 2 is a schematic cross-sectional view taken along line 2—2 of FIG. 1 of the present invention.
Figure 3:
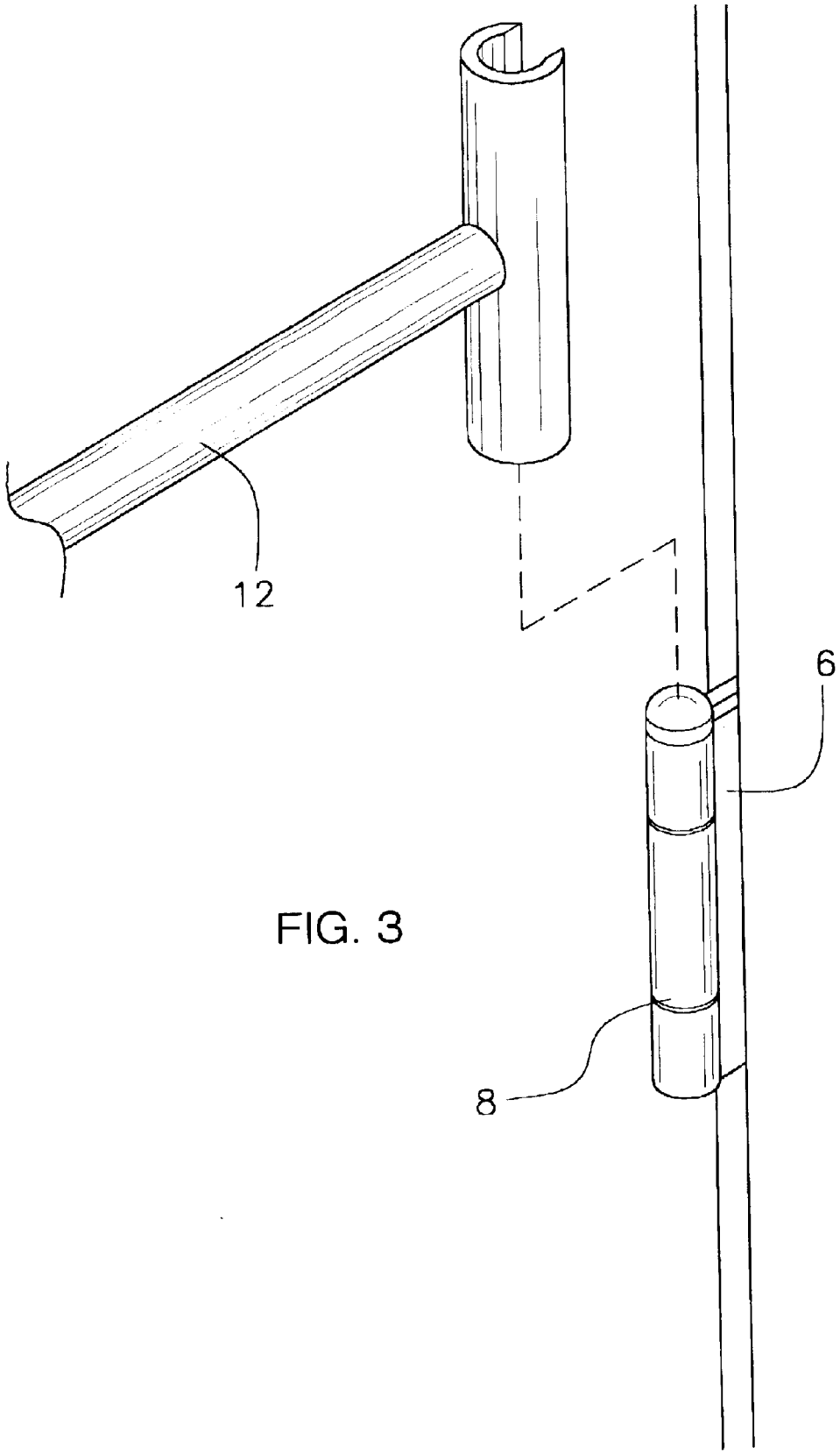
FIG. 3 is a schematic perspective view of the present invention.

With reference now to the drawings, and in particular to FIGS. 1 through 3 thereof, a new tool device embodying the principles and concepts of the present invention and generally designated by the reference numeral 10 will be described.

As best illustrated in FIGS. 1 through 3, the hinge adjusting tool 10 generally includes a rigid elongated member 12 having a first end 14 and a second end 16. The elongated member 12 preferably has a length generally between five inches and fifteen inches. The elongated member 12 is preferably constructed of a metallic material such as an iron alloy which as sufficient rigidity to withstand torque pressures of at least between 10 lbs/in$^2$ and 100 lbs/in$^2$.

A first tubular member 18 is attached to the first end 14 of the elongated member 12. The first tubular member 18 is orientated substantially perpendicular to the elongated member 12. The first tubular member 18 has an upper end 20 and a lower end 22. The first tubular member 18 has a slot 24 extending therethrough. The slot 24 extends between and through the upper 20 and lower 22 ends. The slot 24 is generally directed away from the elongated member 12. The first tubular member 18 preferably has an inner diameter generally between ⅜ inch and ⅝ inch.

A second tubular member 26 is attached to the second end 16 of the elongated member 12. The second tubular member 26 is orientated substantially perpendicular to the elongated member 12. The second tubular member 26 has an upper end 28 and a lower end 30. The second tubular member 26 has a slot 32 extending therethrough. The slot 32 extends between and through the upper 28 and lower 30 ends of the second tubular member 26. The slot 32 in the second tubular member 26 is generally directed away from the elongated member 12. The second tubular member 26 preferably has an inner diameter greater than the inner diameter of the first tubular member 18. The inner diameter of the second tubular member 26 is generally between ⅝ inch and ⅞ inch. It is preferred that both of the first 18 and second 26 tubular members are also constructed of metallic material of the type used for the elongated member 12. Preferably, each of the first 18 and second 26 tubular members preferably have a height from the upper ends 20, 28 to the lower ends 22, 30 generally between 3 inches and 6 inches.

In use, a hinge 6, or more particularly the loop members 8 or knuckles of the hinge 6, may be selectively positioned in one of the first 18 or second 26 tubular members as shown in FIG. 3. The first tubular member 18 has a size adapted for conventional hinges, such as those found within a house. The second tubular member 26 has a size adapted for larger hinges such as those found on fire door and on door for industrial buildings. Once the selected tubular member is positioned on the hinge 6, the hinge 6 may be bent to the left or right until the door to which it is attached swings properly.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hinge adjusting tool comprising:

a rigid elongated member having a first end and a second end;

a first tubular member being attached to said first end of said elongated member, said first tubular member being orientated substantially perpendicular to said elongated member, said first tubular member having an upper end and a lower end, said first tubular member having a slot extending therethrough, said slot extending between and through said upper and lower ends;

a second tubular member being attached to said second end of said elongated member, said second tubular member being orientated substantially perpendicular to said elongated member, said second tubular member having an upper end and a lower end, said second tubular member having a slot extending therethrough, said slot extending between and through said upper and lower ends of said second tubular member, said second tubular member having an inner diameter greater than said inner diameter of said first tubular member;

wherein the hinge may be selectively positioned in one of said first or second tubular members such that the hinge may be repositioned.

2. The hinge adjusting tool of claim 1, wherein said elongated member having a length generally between five inches and fifteen inches.

3. The hinge adjusting tool of claim 1, wherein said slot in said first tubular member is generally directed away from said elongated member, said slot in said second member being generally directed away from said elongated member.

4. The hinge adjusting tool of claim 1, wherein said first tubular member has an inner diameter generally between ⅜ inch and ⅝ inch.

5. A hinge adjusting tool comprising:

a rigid elongated member having a first end and a second end, said elongated member having a length generally between five inches and fifteen inches;

a first tubular member being attached to said first end of said elongated member, said first tubular member being orientated substantially perpendicular to said elongated member, said first tubular member having an upper end and a lower end, said first tubular member having a slot extending therethrough, said slot extending between and through said upper and lower ends, said slot being generally directed away from said elongated member, said first tubular member having an inner diameter generally between ⅜ inch and ⅝ inch;

a second tubular member being attached to said second end of said elongated member, said second tubular member being orientated substantially perpendicular to said elongated member, said second tubular member having an upper end and a lower end, said second tubular member having a slot extending therethrough, said slot extending between and through said upper and lower ends of said second tubular member, said slot in said second tubular member being generally directed away from said elongated member, said second tubular member having an inner diameter greater than said inner diameter of said first tubular member, said inner diameter of said second tubular member being generally between ⅝ inch and ⅞ inch;

wherein the hinge may be selectively positioned in one of said first or second tubular members such that the hinge may be repositioned.

* * * * *